US010927618B2

(12) United States Patent
AlBahrani et al.

(10) Patent No.: US 10,927,618 B2
(45) Date of Patent: Feb. 23, 2021

(54) DELIVERING MATERIALS DOWNHOLE USING TOOLS WITH MOVEABLE ARMS

(71) Applicant: Saudi Arabian Oil Company, Dhahran (SA)

(72) Inventors: Hussain AlBahrani, Qatif (SA); Mohammad Aljubran, Dammam (SA); Timothy E. Moellendick, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 160 days.

(21) Appl. No.: 15/849,948

(22) Filed: Dec. 21, 2017

(65) Prior Publication Data

US 2019/0195035 A1 Jun. 27, 2019

(51) Int. Cl.

| | |
|---|---|
| ***E21B 21/00*** | (2006.01) |
| ***E21B 49/00*** | (2006.01) |
| ***E21B 21/10*** | (2006.01) |
| ***E21B 33/13*** | (2006.01) |
| ***E21B 47/00*** | (2012.01) |
| ***E21B 33/138*** | (2006.01) |
| ***E21B 47/002*** | (2012.01) |

(52) U.S. Cl.

CPC ..... *E21B 21/003* (2013.01); *E21B 21/103* (2013.01); *E21B 33/138* (2013.01); *E21B 47/002* (2020.05); *E21B 49/00* (2013.01)

(58) Field of Classification Search

CPC ..... E21B 33/138; E21B 47/0002; E21B 49/00
See application file for complete search history.

(56) References Cited

U.S. PATENT DOCUMENTS

| | | | | |
|---|---|---|---|---|
| 2,286,673 | A | 6/1942 | Douglas | |
| 2,509,608 | A | 5/1950 | Penfield | |
| 2,688,369 | A | 9/1954 | Broyles | |
| 2,719,363 | A | 10/1955 | Richard et al. | |
| 2,805,045 | A * | 9/1957 | Goodwin | E21B 7/065 175/340 |
| 4,354,559 | A | 10/1982 | Johnson | |
| 5,092,056 | A | 3/1992 | Deaton | |
| 5,890,540 | A | 4/1999 | Pia et al. | |

(Continued)

FOREIGN PATENT DOCUMENTS

| | | |
|---|---|---|
| EP | 2574722 | 4/2013 |
| WO | 2068793 | 9/2002 |
| WO | 2016178005 | 11/2016 |

OTHER PUBLICATIONS

Ashby et al., "Coiled Tubing Conveyed Video Camera and Multi-Arm Caliper Liner Damage Diagnostics Post Plug and Perf Frac," Society of Petroleum Engineers, SPE-172622-MS, Mar. 2015, pp. 12.

(Continued)

*Primary Examiner* — Blake E Michener
*Assistant Examiner* — Theodore N Yao
(74) *Attorney, Agent, or Firm* — Fish & Richardson P.C.

(57) ABSTRACT

A downhole drilling tool and methods for using the tool include a body with a wall that defines an internal volume, and at least one arm attached to the wall, the at least one arm comprising a channel within a body of each arm. The at least one arm provides fluid paths connecting the internal volume to outside the wall, and the at least one arm is displaceable relative to the wall.

15 Claims, 12 Drawing Sheets

(56) References Cited

U.S. PATENT DOCUMENTS 5,947,213 A * 9/1999 Angle ..... E21B 4/18 166/250.01
6,173,795 B1 1/2001 McGarian et al.
8,925,213 B2 1/2015 Sallwasser
9,217,323 B2 12/2015 Clark
2006/0144620 A1* 7/2006 Cooper ..... E21B 17/1014 175/57
2010/0089583 A1 4/2010 Xu et al.
2010/0282511 A1* 11/2010 Maranuk ..... E21B 10/32 175/40
2012/0273187 A1* 11/2012 Hall ..... E21B 47/0905 166/66.5
2014/0083771 A1* 3/2014 Clark ..... E21B 47/08 175/40
2015/0083422 A1* 3/2015 Pritchard ..... E21B 33/13 166/292
2015/0101864 A1* 4/2015 May ..... E21B 10/32 175/27
2015/0267500 A1* 9/2015 Van Dongen ..... E21B 33/14 277/336
2016/0053572 A1* 2/2016 Snoswell ..... C09K 8/508 166/381
2017/0342776 A1* 11/2017 Bullock ..... E21B 7/20

OTHER PUBLICATIONS

International Search Report and Written Opinion issued in International Application No. PCT/US2018/066429 dated Mar. 19, 2019, 14 pages.
GCC Examination Report in GCC Appln. No. GC-2018-36714, dated Mar. 23, 2020, 4 pages.

* cited by examiner

DELIVERING MATERIALS DOWNHOLE USING TOOLS WITH MOVEABLE ARMS

TECHNICAL FIELD

This disclosure relates to delivering materials downhole using tools with moveable arms.

BACKGROUND

In hydrocarbon production, a wellbore is drilled into a geologic formation. In oil or gas well drilling, lost circulation occurs when drilling fluid, known commonly as "mud", flows into one or more geological formations instead of returning up the annulus of the drill string. Lost-circulation materials are the collective term for many substances that can be added to drilling fluids when drilling fluids are being lost to the formations downhole. Commonly used lost-circulation materials are fibrous, such as bark and hair, flaky, such as pieces of plastic, or granular, such as ground limestone, marble, or wood.

Lost circulation can be a serious problem during the drilling of an oil or gas well. The consequences of lost circulation can be disastrous, such as a blowout. Another possible consequence of lost circulation is dry drilling, which occurs when fluid is completely lost from the well bore without actual drilling coming to a stop. Dry drilling can destroy a bit and cause major damage to the wellbore, even requiring a new well to be drilled. Dry drilling can also cause severe damage to the drill string, including snapping the pipe, and the drilling rig itself. Control of lost circulation is important for both safety and economic reasons on a drilling site.

SUMMARY

This disclosure describes tools and methods for delivering materials downhole using tools with moveable arms. The movable arms can be articulated, individually controlled, or both. The tools and methods can be used to deliver materials (for example, fluids and objects) precisely to points of interest downhole, such as delivering lost circulation materials to faults in the walls defining the wellbore. The arms can provide channels to place materials precisely into the downhole area of interest as well as to guide and adjust the materials once placed. These materials can be pumped from the surface through the drill string down to the arms, to areas of interest such as fractures in downhole formation rocks, and cracks in downhole tubulars such as well casings.

In some embodiments, the arms are controlled by an algorithm to place the pumped objects into the areas of interest. The arms also have the ability to perform adjustments to the objects deployed through the arms.

In one aspect, a downhole drilling tool includes a wall body that defines an internal volume, and at least one arm attached to the wall, with at least one arm comprising a channel within a body of each arm. The at least one arm provides fluid paths connecting the internal volume of the wall body to outside the wall, and the at least one arm is displaceable relative to the wall. Embodiments of the tool can include one or more of the following features.

In some implementations, the wall body comprises at least one recess sized to receive at least one arm. The at least one arm can be attached to the wall body at a rotatable joint. In some implementations, the rotatable joint provides one degree of freedom for the at least one arm relative to the wall body. In some implementations, the rotatable joint provides more than one degree of freedom for the at least one arm relative to the wall body. The at least one arm can have an arm joint at a position along the arm distal from the rotatable joint. A magnet can be attached at the end of the at least one arm. In some implementations, the at least one arm includes a first arm and a second arm and the second arm defines a channel with a diameter that is different from a diameter of a channel defined by the first arm. In some implementations, the at least one arm includes a first arm and a second arm, the first arm having a length that is different from a length of the second arm.

In one aspect, a method includes identifying an area of interest in a wellbore formed in a geologic formation, sending one or more objects or solutions from a surface of a mining site to a downhole sub positioned proximate the area of interest, and extending one or more arms attached to the downhole sub and placing the one or more objects or solutions into the area of interest with the one or more arms. Embodiments of the method can include one or more of the following features.

In some implementations, the method further includes identifying the area of interest using 3D imaging tool software. The method can include selecting a type of arm among different types of arms. In some implementations, sending the one or more objects or solutions downhole includes loading the one or more objects or solutions inside the downhole sub and lowering the sub downhole. In some implementations, sending the one or more objects or solutions downhole includes pumping the one or more objects or solutions down a drill string to the sub positioned near the area of interest. The method can include positioning the pumped one or more solutions or objects from reaching a bit at the bottom of the drill string and directing the one or more objects to the arms. The method can include adjusting the one or more objects within the area of interest. The one or more objects can include one of lost circulation material, welding filler material, and surveying tools. The method can include adjusting comprises a coiling of the welding filler material. In some instances, adjusting includes adjusting a diameter of the welding filler material.

In one aspect, a wellbore system includes walls defining a wellbore formed into a geologic formation, a circulation pump configured to circulate fluid through the wellbore, a downhole drilling tool comprising a drill string sub defining an internal volume, and multiple arms attached to the circumference of the drill string sub, each arm comprising a channel within a body of each arm. The multiple arms provide a fluid path from the internal volume of the drill string sub to an outside of the drill string sub, and the multiple arms are displaceable relative to the drill string sub to adjust, guide, and place objects into an area of interest outside of the drill string sub, and a controller in communication with the drilling tool that sends signals to control the movements of the multiple arms. Embodiments of the system can include one or more of the following features.

In some implementations, the drill string is a wired string that provides power to the drilling tool. The power can also be provided by an integrated fiber optics power transmission line. Alternatively or additionally, a downhole power supply unit may provide power to the tool. In some embodiments, the power supply unit can be a rechargeable battery, an energy harvester, a chemical source (for example, a chemical reaction), or a physical source (for example, a spring-wound mechanism).

In some implementations, the controller controls each arm independently from the other arms.

Advantages of these tools and methods include the ability to deliver non-fluid material in addition to fluid material. These tools and methods can also place material in the wellbore at specific locations. For example, these tools and methods can apply material to faults in the walls defining a wellbore. This feature provides more operational flexibility than systems that employ a circulation sub that provides a secondary conduit for fluid flow from the drill string into the wellbore that pushes those fluids out into the wellbore without placing the fluids at specific locations and without the ability to deliver solids, Another advantage of these tools and methods is that they can manipulate non-fluid material after delivery to the area of interest.

As used in this disclosure, the term "drill string" or "string" refers to a column of drill pipe that transmits drilling fluid and torque to a drill bit.

The details of one or more embodiments of the tools and methods are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

This disclosure describes tools and methods for delivering materials downhole using tools with moveable arms. The movable arms can be articulated, individually controlled, or both. The tools and methods can be used to precisely deliver materials (for example, fluids and objects) to points of interest downhole, such as delivering lost circulation materials to faults in walls defining the wellbore. The multiple arms can provide channels to accurately place materials into the downhole area of interest as well as to guide and adjust the materials once placed. The materials can be pumped from the surface through the drill string down to the arms, or can be positioned within the tool before the drill string is sent downhole and then deployed when needed. The areas of interest for placing the objects or solutions include fractures in downhole formation rocks and cracks in downhole tubulars, such as well casings. The arms can be controlled by an algorithm that accurately places the objects or solutions into the areas of interest. The arms also have the ability to perform adjustments to the objects the arms are delivering to the area of interest.

Figure 1:
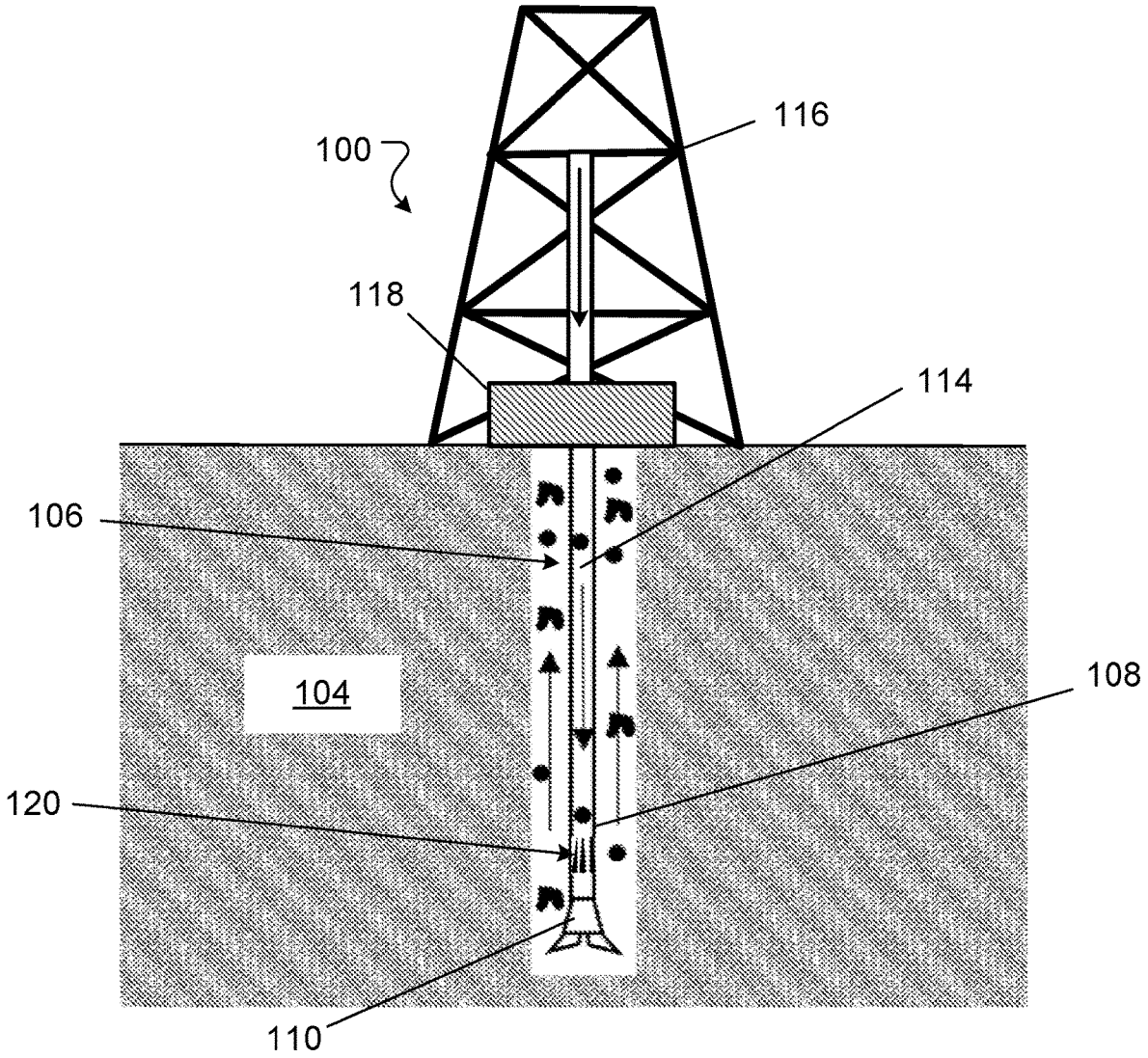
FIG. 1 is a schematic diagram of an example wellbore circulation system.

FIG. 1 shows an example well drilling system 100 that includes a drilling tool 120 with multiple movable arms. The well drilling system 100 includes a drill derrick 116 that supports the weight of and selectively positions a drill string 108 through a blowout preventer and well head 118. The drill string 108 has a down-hole end connected to a drill bit 110 that drills the wellbore 106 in the formation 104. A pump (not shown) circulates drilling fluid 114 though the wellbore 106, by pumping the fluid 114 to the top end of the drill string 108, through the well head 118, then down through the drill string 108 to enter the wellbore 106 through the drill bit 110. After exiting the drill bit 110, the fluid 114 flows up through the wellbore annulus (for example, the wellbore 106 outside of the drill string 108) toward the well head and to a "mud" pit.

The drilling tool 120 can be used downhole in wellbores 106 to accurately deliver solutions and objects to points of interest downhole.

Figure 2A:
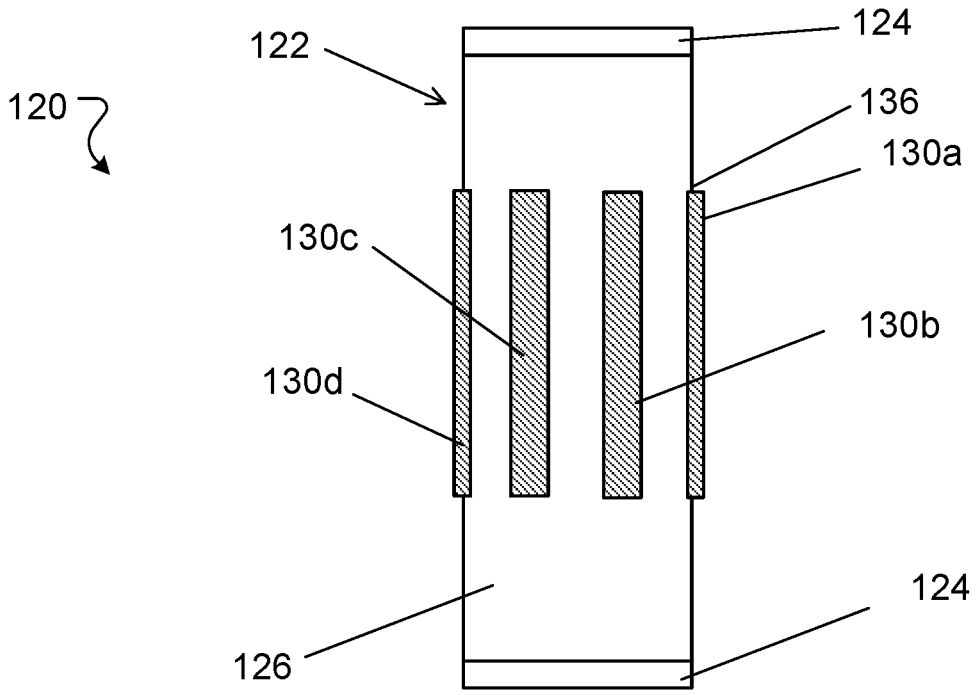
FIGS. 2A-2F are possible configurations of a sub with multi-arm tool used to deliver materials downhole.
Figure 2B:
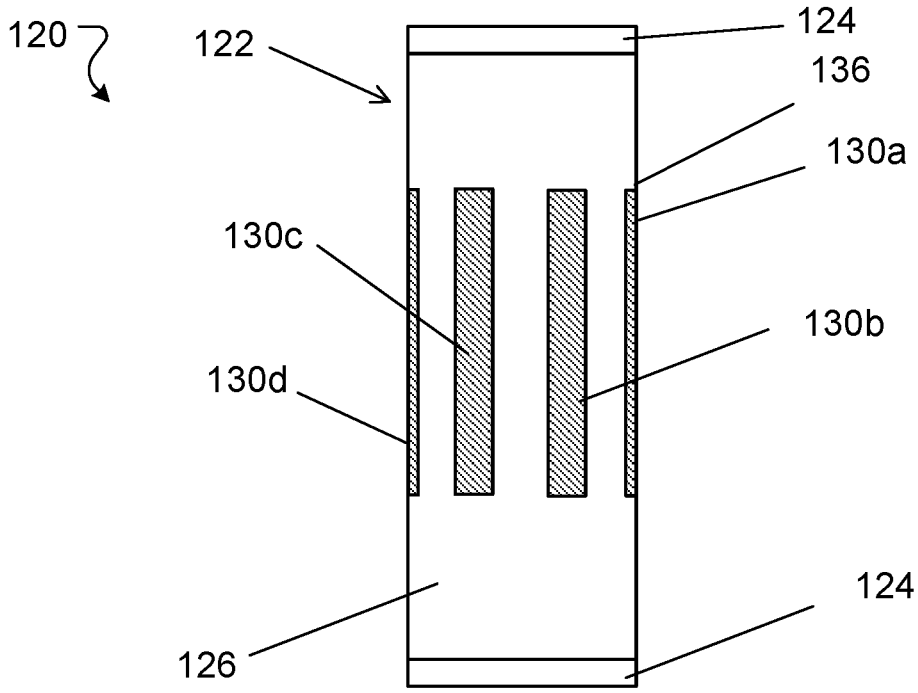

FIGS. 2A and 2B show the drilling tool 120 integrated into a delivery while drilling (DWD) sub 122. It is also possible to integrate the drilling tool 120 within other subs such as an annular communication ports sub where applicable. These other subs can be considered for applications in large diameter boreholes (for example, larger than 16 inches in diameter). The placement of the sub 122 is in the bottom hole assembly (BHA), where it can be located uphole of logging while drilling (LWD) and measurement while drilling (MWD) subs, and uphole of the bit 110 (shown in FIG. 1). Alternatively, the arms can be placed directly uphole of the bit subs in cases where LWD or MWD subs are not being employed, which can be useful in non-reservoir sections.

The DWD sub 122 has a wall 126 with the multiple movable arms 130*a*, 130*b*, 130*c*, 130*d* arranged around the circumference of the wall 126. The drilling tool 120 has six arms of which four arms 130*a*, 130*b*, 130*c*, 130*d* are visible in FIGS. 2A and 2B. Other tools are implemented with other numbers of arms.

In FIG. 2A, the recesses 134 around the circumference of the sub wall 126 are slightly shallower than the depth of the arms so that each arm partially fits within a respective recess 134 when retracted. In FIG. 2B, the recesses 134 around the circumference of the sub wall 126 are deep enough that each arm 130*a*, 130*b*, 130*c*, 130*d* fits completely within a respective recess 134 when retracted. In FIG. 2A, the protrusion circumference is slightly beyond the wall 126 of the DWD sub. The protrusion of the retracted arms should be no more than 20% of the DWD wall outside diameter. The arms may also be a material of construction that permits them to be flexible under a certain load of force that permits them to bend inside the DWD body or interior.

The DWD sub 122 can be integrated into the drill string 108 at sub connection points 124. For example, the sub connection point 124 between the DWD sub 122 and the drill string 108 is configured in a similar fashion to known circulation subs such as, for example, subs commercially available from PBL Drilling Tools Ltd., that allow the connection points 124 to function as a conduit of flow inside of the drill string 108.

Articulated Arm Structure

The multiple moveable arms 130*a*, 130*b*, 130*c*, 130*d* of the drilling tool 120 can accurately adjust, guide, and place materials into an area of interest down hole. These objects can be, for example, fluids, specially designed lost circulation material, welding filler material, and surveying tools.

In the illustrated embodiment, the arms 130*a*, 130*b*, 130*c*, 130*d* are an integral part of the DWD sub 122 attached to the BHA at the bottom of the drill string 108. It is desirable that the arms 130*a*, 130*b*, 130*c*, 130*d* are attached to the sub in such a way that they do not add significantly to the outside diameter of the DWD sub 122 or the BHA as a whole. As previously discussed, FIG. 2A shows a tool 120 in which the arms 130*a*, 130*b*, 130*c*, 130*d* slightly protrude from the DWD sub 122, while in the implementation shown in FIG. 2B, the arms are flush with the outside diameter of the DWD sub 122.

The arms 130*a*, 130*b*, 130*c*, 130*d* can be individually controllable. The arms 130*a*, 130*b*, 130*c*, 130*d* can extend outwards from the wall 126 of the DWD sub 122 to perform a job. The arms 130*a*, 130*b*, 130*c*, 130*d* can be configured in various ways to provide this functionality.

Figure 2C:
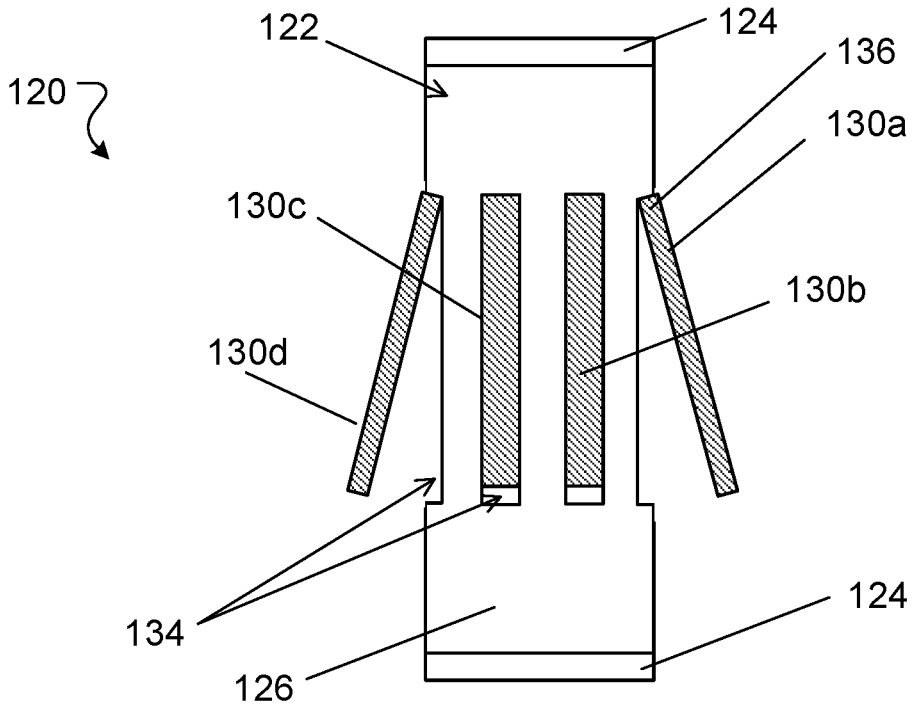

FIG. 2C shows a tool 120 in which the arms 130*a*, 130*b*, 130*c*, 130*d* rotate away from the wall 126. In this exemplary implementation, the wall 126 of the DWD sub 122 includes recesses 134 around the circumference of the sub that align with each arm 130*a*, 130*b*, 130*c*, 130*d*. Each recess 134 is approximately the length, width, and depth of each arm 130*a*, 130*b*, 130*c*, 130*d* such that the recess is the negative space of each arm. After finishing a job, each deployed arm retracts to contact the sub wall 126 fitting within a respective recess 134 such that, when retracted, the arms do not protrude beyond the wall 126.

Figure 2D:
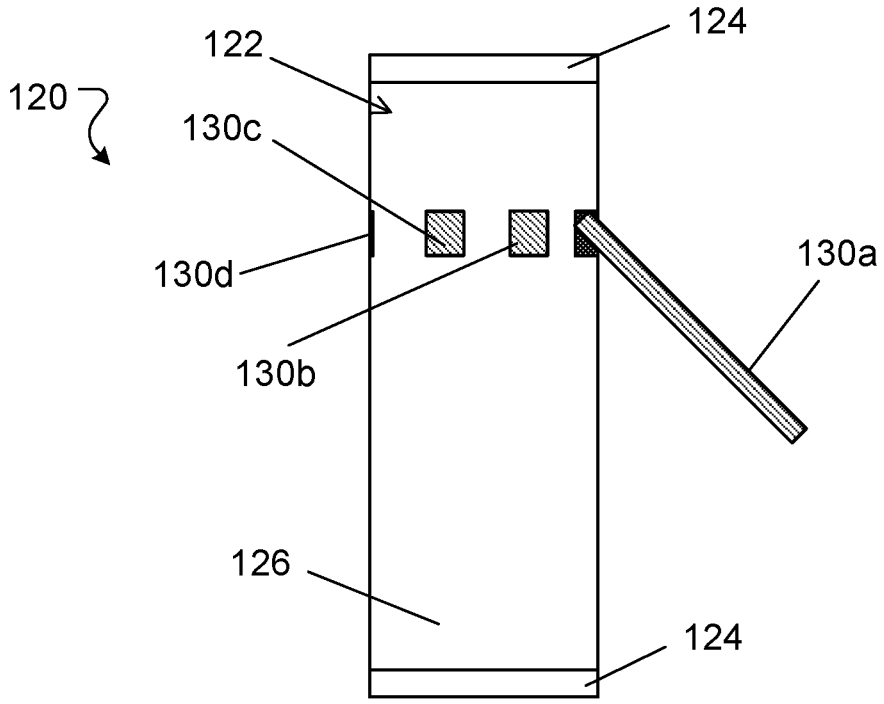

FIG. 2D shows a tool 120 in which the arms 130*a*, 130*b*, 130*c*, 130*d* retract fully to within the DWD sub 122, when not in use placing or positioning material in the wellbore. One arm 130*a* is shown extended to perform a delivery or placement function while the other arms 130*b*, 130*c*, 130*d* are retracted within the sub wall 126. When retracted, the end or tip of each arm 130*a*, 130*b*, 130*c*, 130*d* can be flush with the wall 126 of the sub such that the arms do not increase the diameter of the DWD sub 122. To fit inside the wall, the arms 130*a*, 130*b*, 130*c*, 130*d* may have articulations that allow the arms to bend or rotate into a bent and retracted position.

The drilling tool 120 integrated into the DWD sub 122 can be configured to accommodate a wide range of sizes of wellbores 106. For example, wellbores used in oil and gas recovery typically have diameters from 42 inches to less than 5⅞ inches. The diameter of a wellbore impacts the diameter of the appropriate tool to be used in the wellbore and the diameter of the tool 120 impacts the number of arms that can be incorporated into the tool 120. Some tools 120 have as many as 50 arms. Some tools 120 have as few as 1 arm. The number of arms 130*a*, 130*b*, 130*c*, 130*d* in a specific drilling tool 120 will depend on the size of the hole section targeted, the size of the point of interest, and the delivery item to be delivered. For example, narrow wellbores (for example, wellbores with a diameter between 8 and 3 inches) often have small fractures that can typically be plugged with a small amount of liquid lost circulation materials, so a DWD sub 122 deployed downhole may have only four arms. A large wellbore (for example, wellbores with a diameter between 9 and 42 inches) may use a DWD sub 122 that is larger in diameter (for example, with a diameter between 8.8 and 41.1 inches) and that has 8-12 arms to more accurately target areas of interest. The diameter of the sub is calculated to provide a minimum clearance of around 2% between the sub and the wellbore wall.

The diameter, length, and shape of the arms vary based from situation to another based on the diameter of the section targeted and the size of the point of interest and the solution to be delivered. To accommodate differently sized wellbores 106, different tools have arms of different lengths, for example, from about 0.5 inches to about 20 inches. Similarly, different tools have arms of different diameters, for example from about 0.2 inches to about 10 inches.

In most instances, the arms are hollow to provide a channel 140 inside the body of each arm. The outer shape and the channel shape of the arms 130*a*, 130*b*, 130*c*, 130*d* will configured based on the nature of the solution to be delivered and based on the adjustments to be performed on the solution downhole prior to its delivery to the point of interest. For example, arms intended to deliver only fluid materials typically have a circular cross sectional shape and a circular channel. Arms intended to extrude a coil of filler material typically have a channel diameter sized so that the extruded filler material is of a diameter to be most easily worked with. For a DWD sub 122 designed to enter a smaller sized wellbore 106, (for example, 8⅜ inches or less) the arms can be solid rather than hollow.

The DWD subs 122 illustrated in FIGS. 2A-2C, 2E, and 2F have arms 130*a*, 130*b*, 130*c*, 130*d* that connect to the sub wall 126 at sub joints 136. Sub joints 136 are rotatable joint and can have a single degree of freedom (for example, a hinge joint) or multiple degrees of freedom (for example, a ball joint). Sub joints 136 allow the arms to rotate away from the wall 126 up to 90 degrees.

Figure 2E:
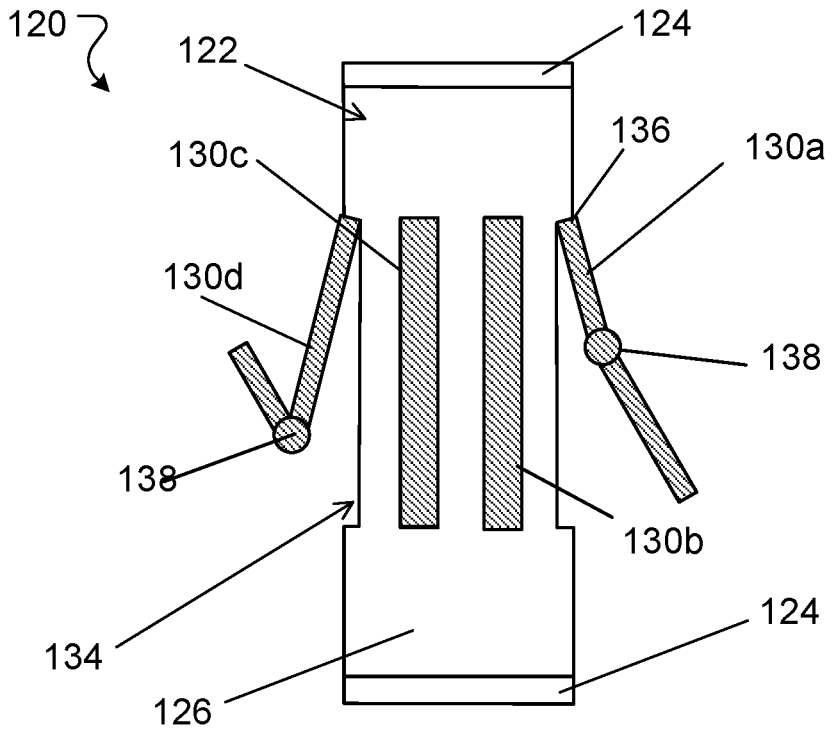
Figure 2F:
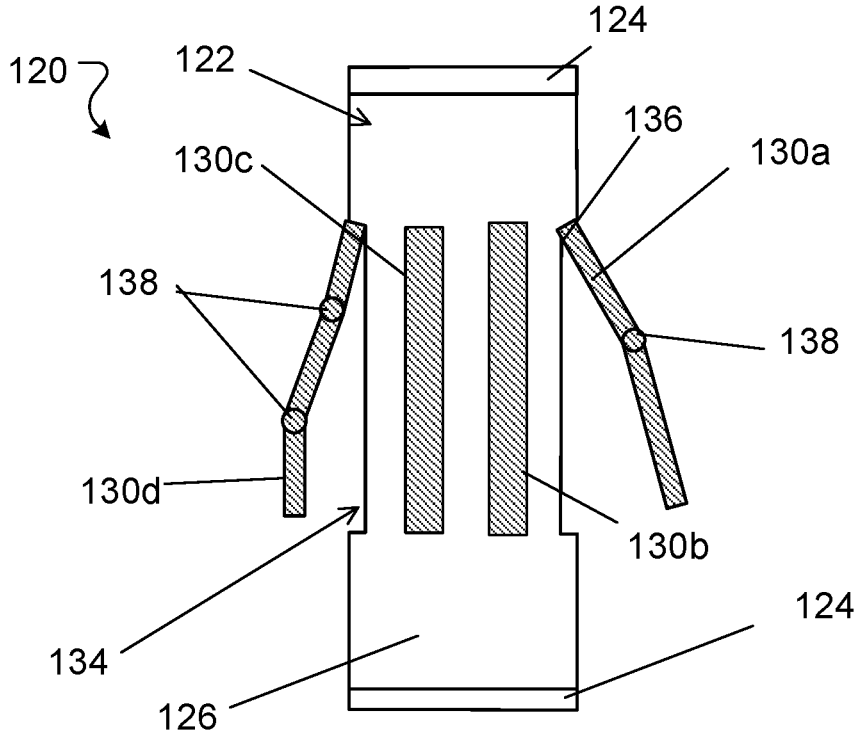

FIGS. 2E and 2F show tools 120 for larger sized wellbores, (for example, greater than 16 inches) in which each arm 130*a*, 130*b*, 130*c*, 130*d* has more than one articulated member. Although the illustrated arms have two articulated members, some arms have more than two articulated members, Two arms 130*b*, 130*c* are retracted and two arms 130*a*, 130*d* are extended relative to the wall 126 of the. As can be seen on the extended arms 130*a*, 130*d*, the arms are articulated both where each arm meets the wall at sub joint 136 and at arm joints 138 along the length of the arms. The arm joints 138 can have a single degree of freedom (for example, a hinge joint) or more than one degree of freedom (for example, a ball joint), and can allow the portions of the arm downhole of the joint 138 to articulate away from the body of the DWD sub 122 (FIG. 2E), or towards it (FIG. 2F). In some implementations, more than one arm joint 138 on an arm is possible (see, for example, arm 130*d* in FIG. 2F).

The implementations of the DWD sub 122 shown in FIGS. 2A-2F are configured to have arms which reach all points in a wellbore. Different locations along a wellbore can be reached by either moving the DWD sub 122 uphole or downhole, by rotating an arm 130*a*, 130*b*, 130*c*, 130*d* toward or away from the wall of the wellbore, or both. Similarly, different portions of the wall of the wellbore at a specific location can be reached by rotating an arm 130*a*, 130*b*, 130*c*, 130*d* via sub joint 136 or arm joint 138, by rotating the entire sub 122 so that a desired arm 130*a*, 130*b*, 130*c*, 130*d* is located near the position of interest, or both.

The end of each arm 130*a*, 130*b*, 130*c*, 130*d* distal from the wall 126 can have multiple configurations. The ends can be smooth, for example simple outlets for channels 140. The ends can include specialized tools, such as a magnet to manipulate metallic objects delivered by the DWD sub 122, or welding or sparking tools.

A DWD sub 122 can have arms that are all identical, or one or more of the arms are different from the other arms. For example, a single DWD sub 122 can have one or more arms that is/are a different length, cross section, or channel shape from the other arms, or has a different type of number of joints or tool attached to the end.

Delivering Solutions Downhole

Figure 3:
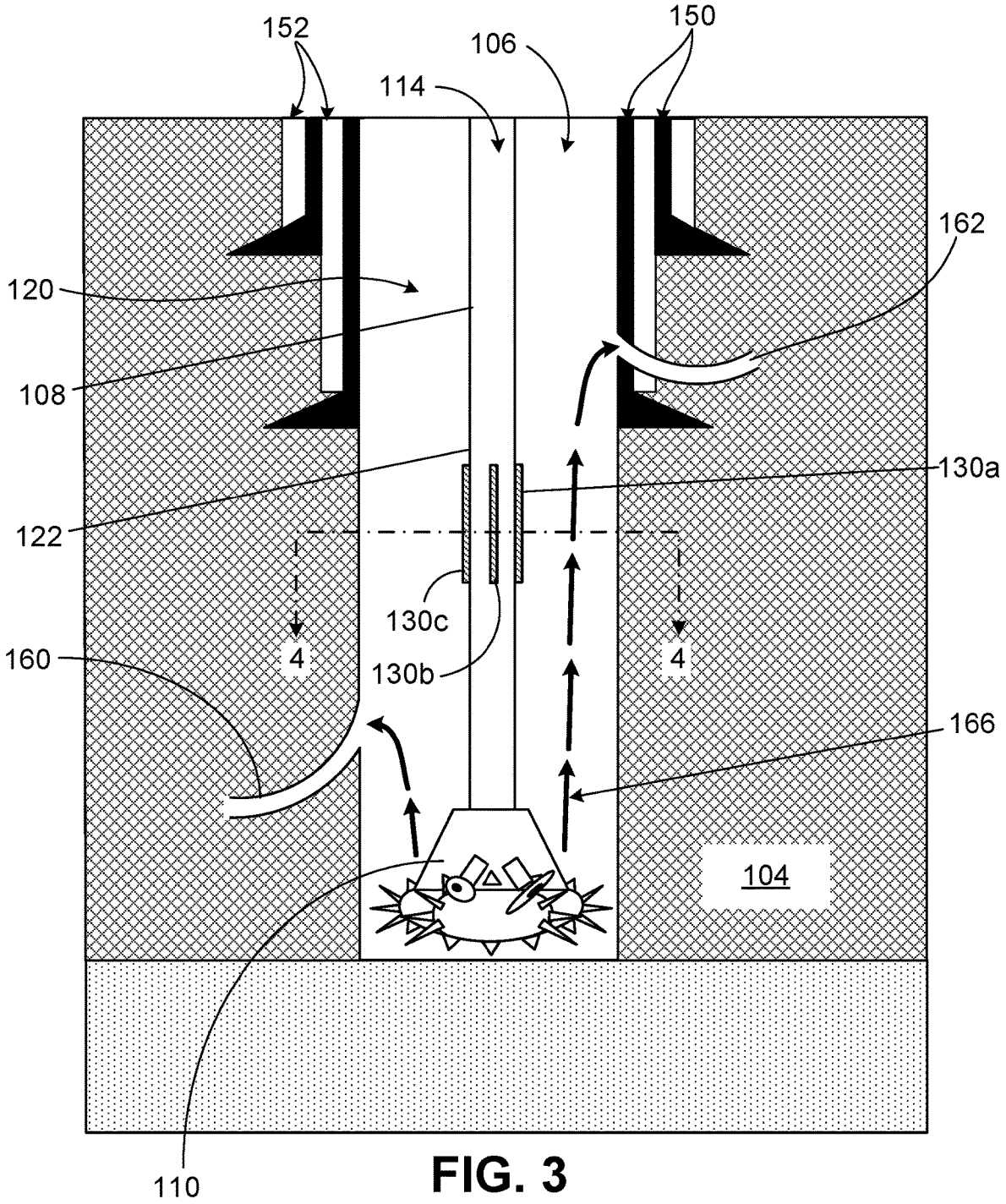
FIG. 3 is a side view schematic of a multi-arm delivery tool integrated into a drill string and deployed downhole.

FIG. 3 shows the general configuration of the drilling tool 120 within the drill string 108 downhole in a wellbore 106. The drill hole includes well casing tubulars 150 and well casing cement 152 that support walls of the wellbore 106. This system includes fractures or cracks in the downhole tubulars 150 and well casings 152 such as fault 162 and conductive fractures or caverns in the formation rock such as fault 160. Such faults 160, 162 generate lost circulation, with at least a portion of drilling fluid 114 flowing into the geological formations as indicated by arrows 166 instead of returning up the annulus of the drill string as shown in FIG. 1. Lost circulation can be a serious problem during the drilling of an oil well or gas well, leading to possible blowout, or dry drilling when fluid is completely lost from the well bore without drilling coming to a stop. Lost circulation is very costly due to accidents, or from having to stop drilling and deploy a solution downhole to prevent an accident, as well as being unsafe.

Figure 4:
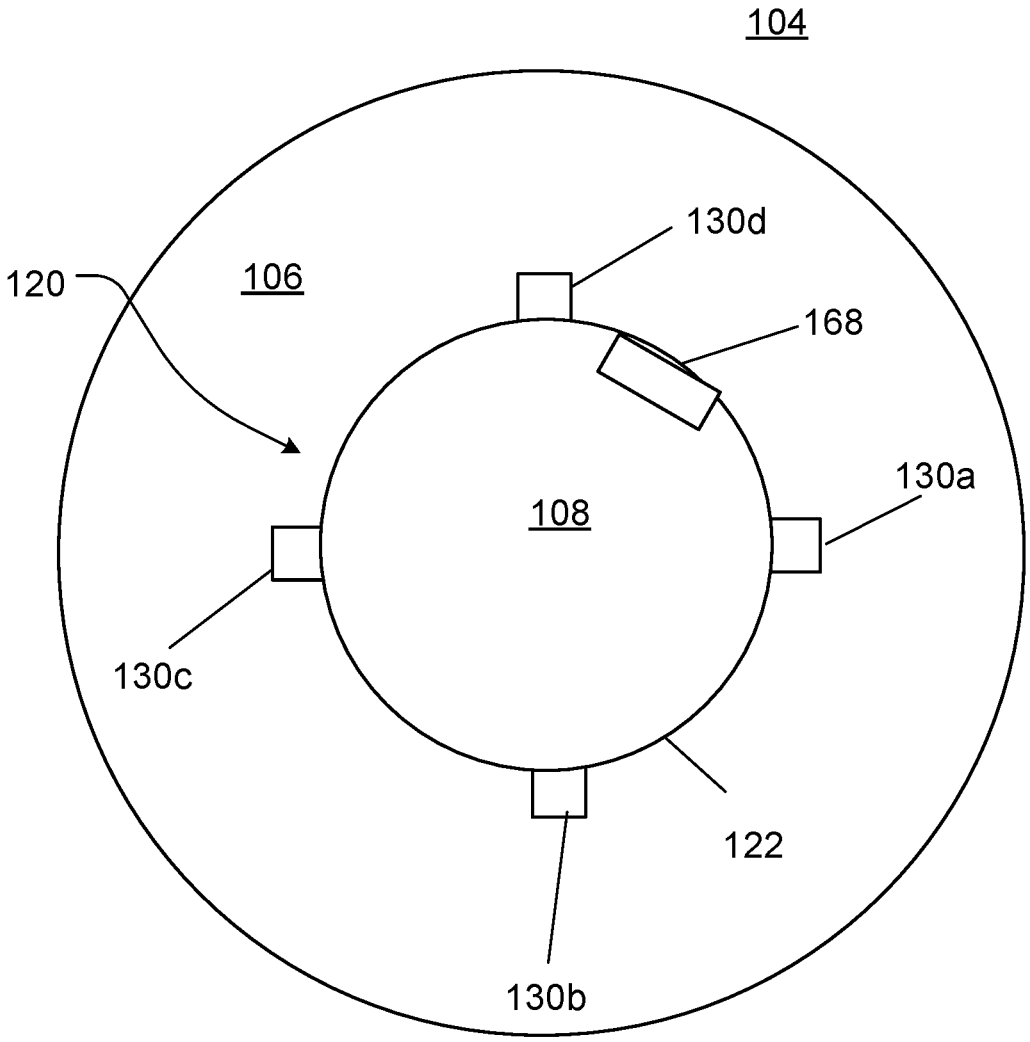
FIG. 4 is a plan view schematic of the delivery tool of FIG. 3 near a fault.

FIG. 4 is a plan view schematic of a delivery tool of FIG. 3 at the position of fault 162.

Various objects are delivered from the surface through the drill string 108 to the arms 130*a*, 130*b*, 130*c*, 130*d* of the drilling tool 120 including lost circulation materials, in either liquid or granular form. Examples include silica or thermoset epoxies. Depending on the quantity and nature of the solution or object to be delivered, the drilling tool 120 can have the solution or object to be delivered attached to the DWD sub 122 when the sub is sent downhole. The tool 120 includes a delivery item compartment 168 embedded inside the DWD sub 122 that is accessible by the arms 130*a*, 130*b*, 130*c*, 130*d* (see FIG. 4).

In some instances, the particular solution or object to be delivered is pumped down into the drill string 108 and deployed. This technique is employed, for example, if the delivery item is too large to be embedded into the sub, or if an unexpected problem and, thus, an unanticipated particular delivery item is required. In such instances, the solution or object is pumped into the string 108 from the surface. The delivery item is received and diverted towards the articulated arms 130*a*, 130*b*, 130*c*, 130*d* sub through a ball latch and release configuration (not shown).

Figure 5:
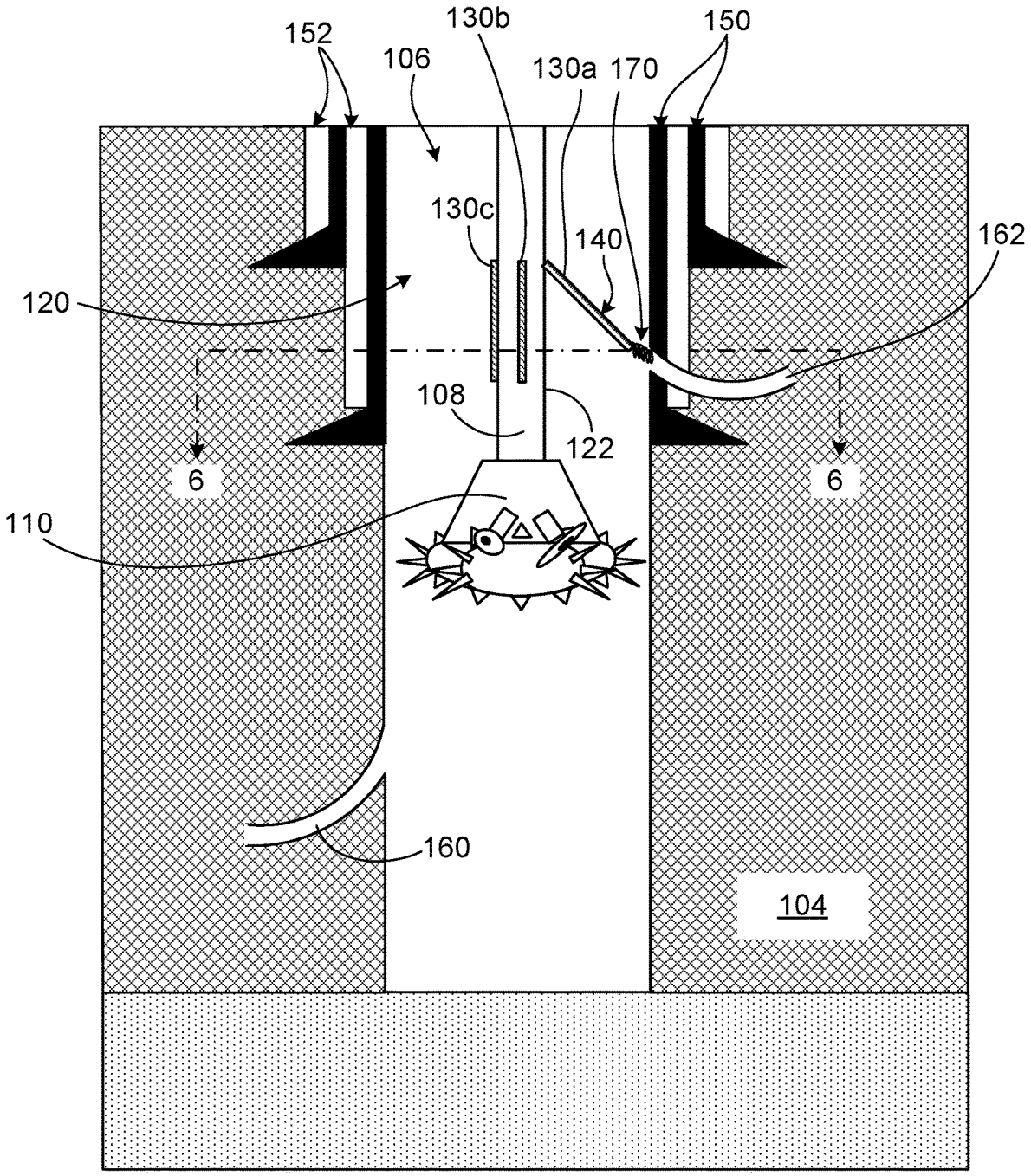
FIG. 5 and FIG. 6 show placement of material into an area of interest downhole.
Figure 6:
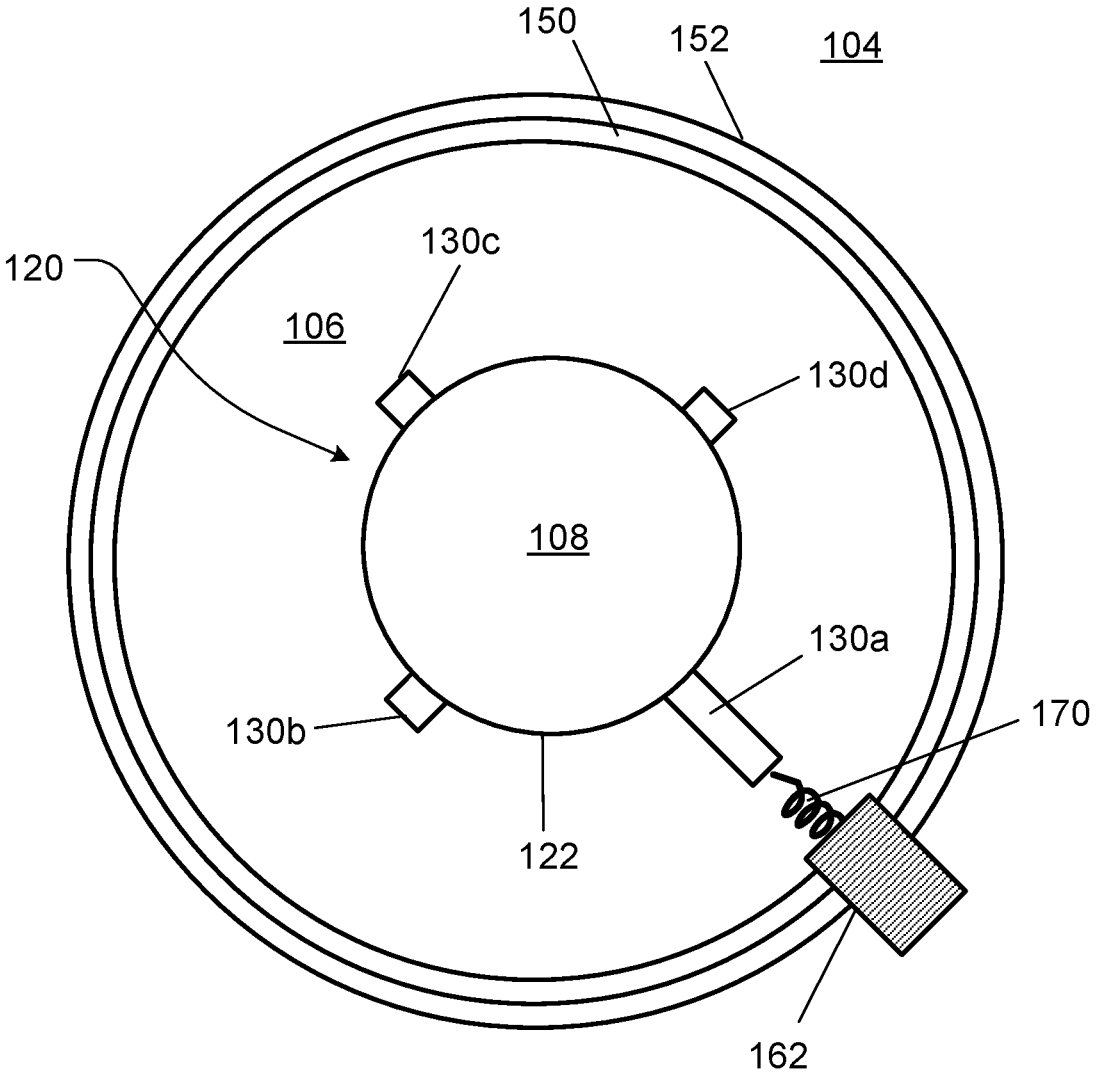

FIGS. 5 and 6 show the tool 120 being used to repair the fault 162 in the metal well casing tubulars 150. In this case, a particularly useful item to be delivered is a filler material used for welding the well casing tubular 150. In this application, the delivery object is a thin, coiled tube 170 of the filler material. Coiled tubes 170 are placed within the DWD sub 122 prior to running the drill string 108 into the wellbore 106 (for example, in a delivery item compartment). The drilling tool 120 is moved to the area of fault 162, so that the arms 130*a*, 130*b*, 130*c*, 130*d* can reach the area of interest. The nearest arm 130*a*, 130*b*, 130*c*, 130*d* (or arms) extrudes coiled tube 170 to the fault. Another tool (for example a welding tool with a mounted on one of the arms) be used to manipulate the filler material after delivery.

In most tools, the arms are able to operate separately. In FIGS. 5 and 6, a single arm 130*a* is deployed to move the coiled tube 170 to the fault 162 extending through the well casing tubular 150 and well casing cement 152. Alternately, based on the requirements of the planned operation, several arms 130*a*, 130*b*, 130*c*, 130*d* can to operate together to deliver the downhole solution to the area of interest acting in concert. In some instances, arms 130*a*, 130*b*, 130*c*, 130*d* can operate simultaneously but independently, for example, with two different arms targeting two different areas of interest at the same time.

Directing Arm Action

A ball latch and release configuration, similar to those used in circulation subs commercially available from PBL Drilling Tools Ltd. to open and close annulus communication ports of the sub, is operable to restrict flow of mud to the bit 110 at the point of the articulated arms of the DWD sub 122. The DWD sub 122 can activate a specific arm or arms by feeding the flow into the specific arm or arms best placed to reach the point of interest. The arm or arms can be designated based on the pre-programmed location of the point of interest obtained during a 3D imaging process (described below).

The latch configuration is operable to stop the pumped material flow inside the string from reaching the bit and restrict it to reach the articulated arms sub. It is also used to direct the pumped material into the articulated arms 130*a*, 130*b*, 130*c*, 130*d* to facilitate the feeding process for solution delivery rather than simply triggering communication between the string and the annulus, as is the case with the sub commercially available from PBL Drilling Tools Ltd. When the ball is latched into the latch and release configuration, it will restrict the flow within the drill string from reaching the bit and activate the inner latch sleeve of the sub 122 to enable it to latch into the pumped solution, i.e. filler material for welding.

One or more of the arms 130*a*, 130*b*, 130*c*, 130*d* can made adjustments to the delivered item just prior to placing it in the area of interest. Adjustments include but are not limited to coiling of a welding filler material, or adjusting the diameter of the welding filler material. The arms 130*a*, 130*b*, 130*c*, 130*d* are configured in specific and distinct ways as needed to perform each distinct adjustment. For example, to adjust a coil diameter, the arm 130*a*, 130*b*, 130*c*, 130*d* will feed from a tube of filler material that is of a desired diameter and it will force it through a port of a smaller diameter. To coil the welding filler material, the same concept is used where the arm will feed from a tube of filler material and forces it through a coiled path within the arm itself.

Power Supply and Control Algorithm

Figure 7A:
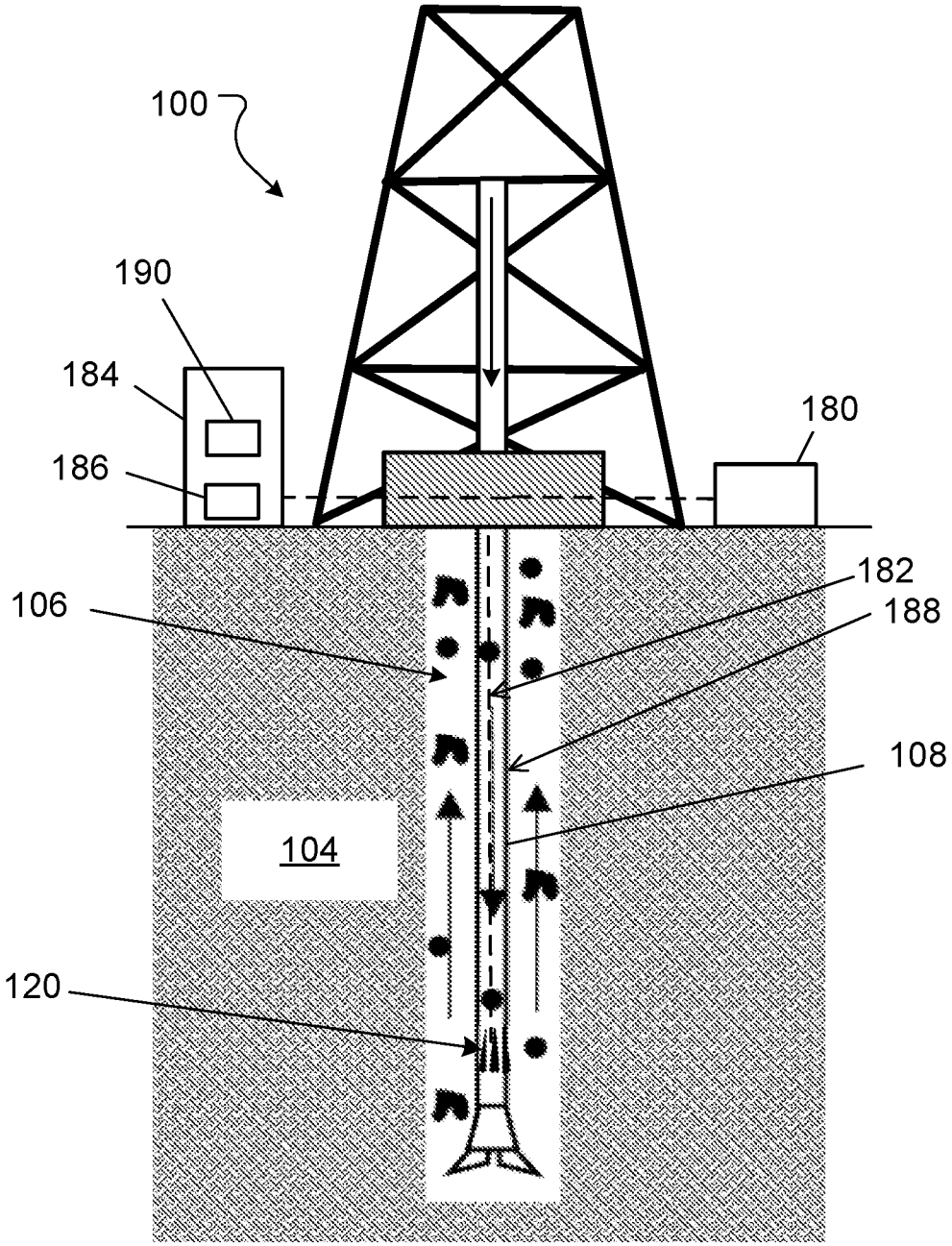
FIG. 7A and FIG. 7B are schematic views showing power and control lines between the surface and the multi-arm delivery tool downhole.
Figure 7B:
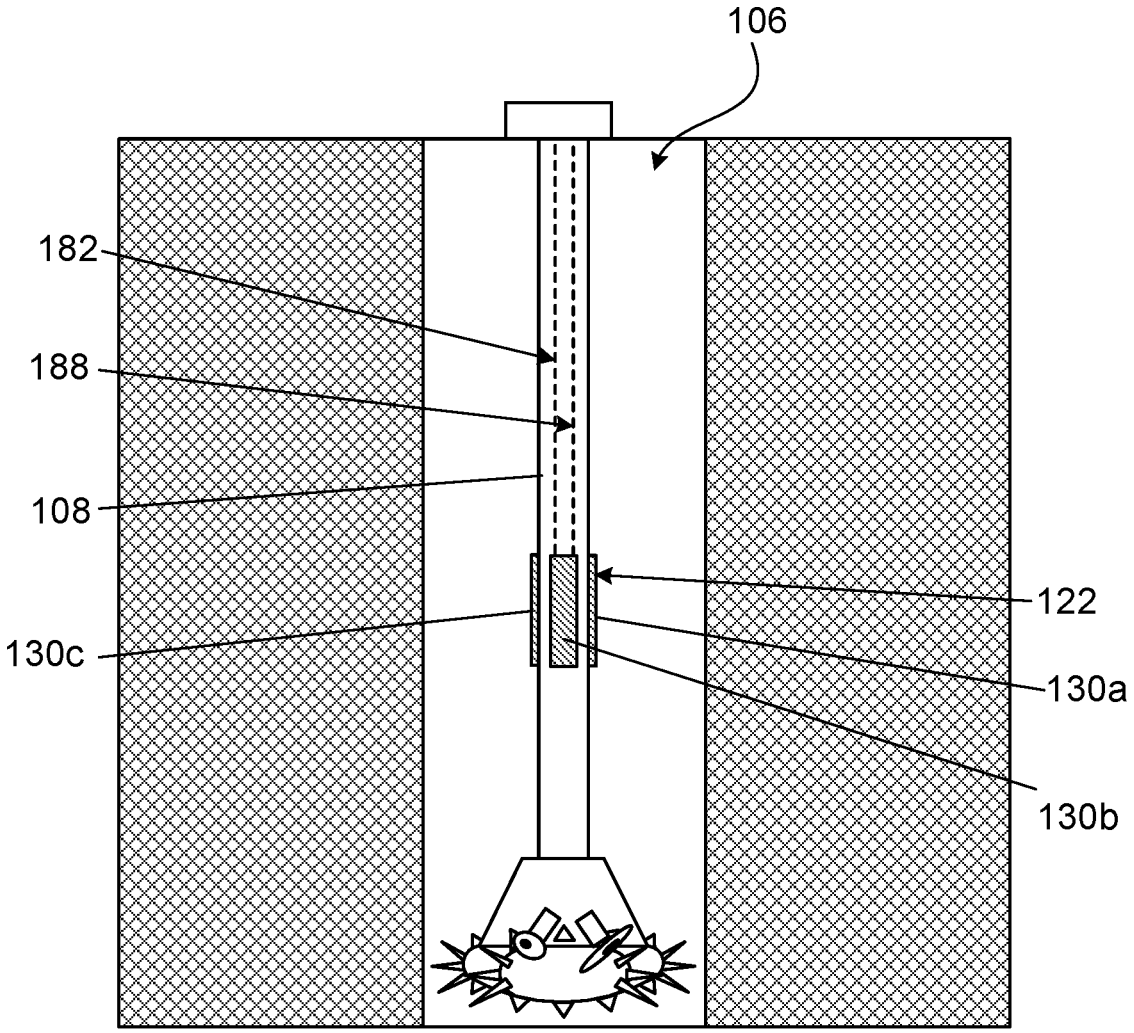

FIGS. 7A and 7B shows the drill string 108 used with the drilling tool 120 includes wired drill pipes. A power source 180 transfers the power required to operate the arms 130*a*, 130*b*, 130*c* downhole via the wired drill pipes, depicted by lines 182. The power supply for the articulated arms 130*a*, 130*b*, 130*c* can be provided by intelligent-wired drill-pipes can be used to provide power supply from a source on the surface. This includes the use of fiber optics as an integrated power transmission line throughout the drill string. Alternatively, the power supply for the articulated arms 130*a*, 130*b*, 130*c* can be provided by a downhole power supply unit that is run as an integral part of the drills string. This unit can also be in the form of a rechargeable battery or an energy harvester.

A surface-based controller 184 is programmed with an algorithm 186 stored on the controller 184 that sends instructions downhole as depicted by lines 188. The algorithm 186 directs the arms 130*a*, 130*b*, 130*c* to place the deployed materials into the areas of interest accurately.

In some instances, the algorithm 186 is programmed into the controller 184 so that the drilling tool 120 functions as an autonomous system. The algorithm 186 uses specific coordinate, location, and dimension details of a point of interest obtained through a 3D imaging tool software 190. A tool scans walls of the wellbore 106. The imaging tool software 190 constructs a model based on scan data provided by the tool.

Analysis of the wellbore model is performed to identify points of interest and to determine coordinates of the point of interest. In an autonomous system, the identification of points of interest may be performed autonomously by the imaging tool software 190. However, this analysis is typically performed in an iterative process with an initial analysis performed by the imaging tool software 190 being reviewed and accepted or rejected by an operator.

Using the information obtained by the imaging tool software 190, the algorithm 186 uses the specific coordinates, location, and dimensions details of each point of interest to prompt the appropriate articulated arm 130*a*, 130*b*, 130*c* to deploy when the targeted location is reached. A particular arm 130*a*, 130*b*, 130*c* may be selected as appropriate if it is the type designed for the particular task, for example, size, shape, has the needed tool attached. Using this algorithm 186, no operator interference is required to control the drilling tool 120 from the surface to deliver solutions to the targeted areas. The arms 130*a*, 130*b*, 130*c* perform adjustments to the objects pumped through the arms including coiling of a welding filler material 170 and adjusting the diameter of the welding filler material 170, in response to commands sent by the algorithm 186.

With such an autonomous system, an operator's only role is to connect the DWD sub 122 into the BHA and start the systems running in the wellbore. Any further prompts to deploy the arms 130*a*, 130*b*, 130*c* when the area of interest is reached are issued automatically through the algorithm 186.

Figure 8:
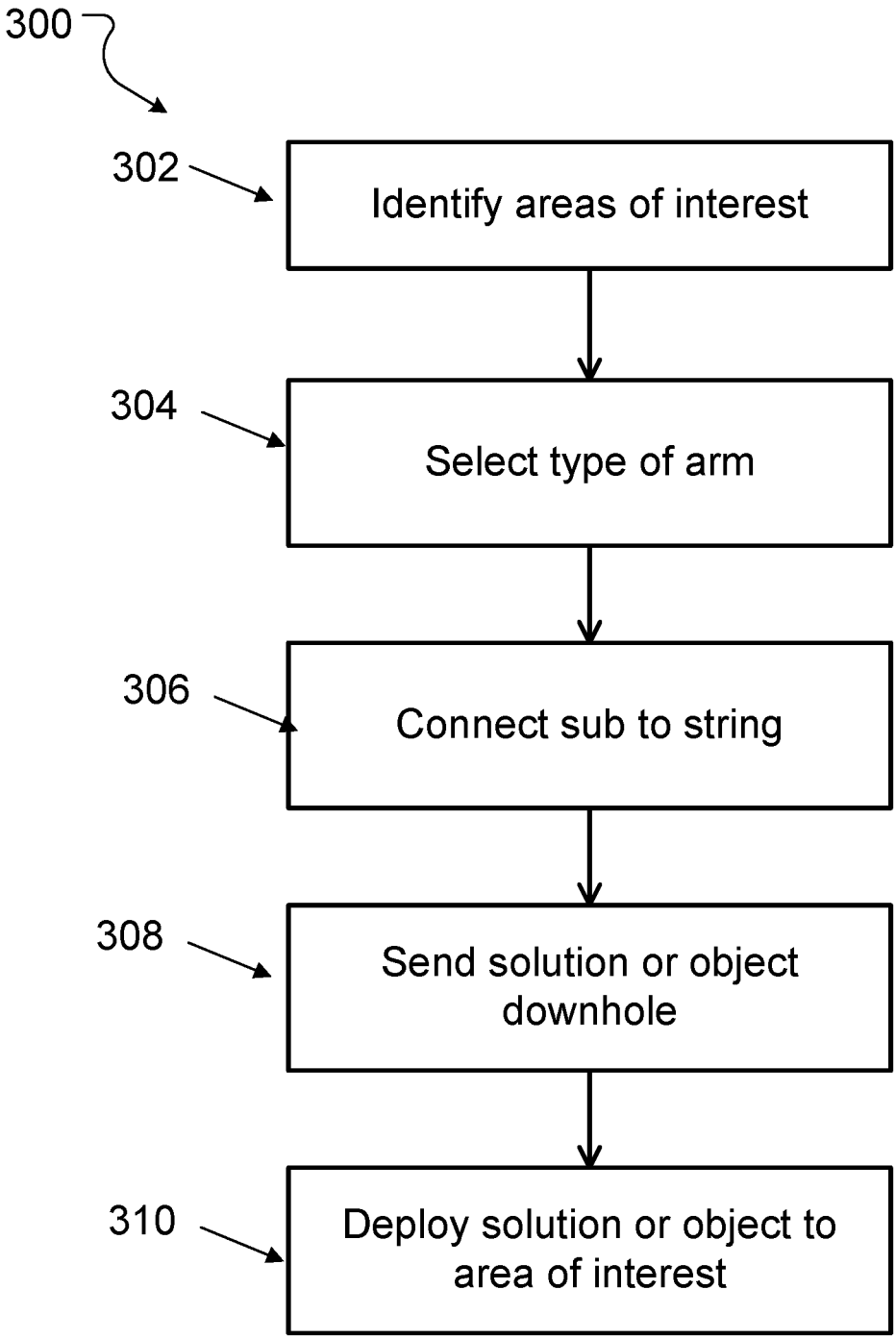
FIG. 8 is a flow diagram of the steps for using the multi-arm delivery tool.

FIG. 8 depicts a method 300 for using a DWD sub. The method 300 can be performed with an operator controlling steps such the identification and location of areas of interest or by an autonomous system. The following discussion describes the method as performed by an operator.

At step 302, an operator identifies areas of interest using 3D imaging tool software 190, and saves their coordinate and dimensions details. Either the operator or the algorithm 186 selects the appropriate type of arm to respond to the details of the area of interest, step 304. In some instances, the selection is automatic if there is only one type of arm 130*a*, 130*b*, 130*c* integrated into the DWD sub 122. The operator may optionally load the needed solution or solid into a delivery item compartment. The operator connects the DWD sub 122 into the BHA and starts it running in the wellbore, step 306. The operator also sends the solution or object downhole, step 308. Sending the solution or object downhole can be simultaneous with sending the sub downhole if using a delivery item compartment. Alternatively, sending a solution or object downhole can involve pumping it downhole. Either the operator or the algorithm 186 deploys the solution or objection to the area of interest when the DWD sub 122 reaches the correct location, step 310. Step 310 can be repeated as many times as necessary depending on the number of areas of interest.

Figure 9:
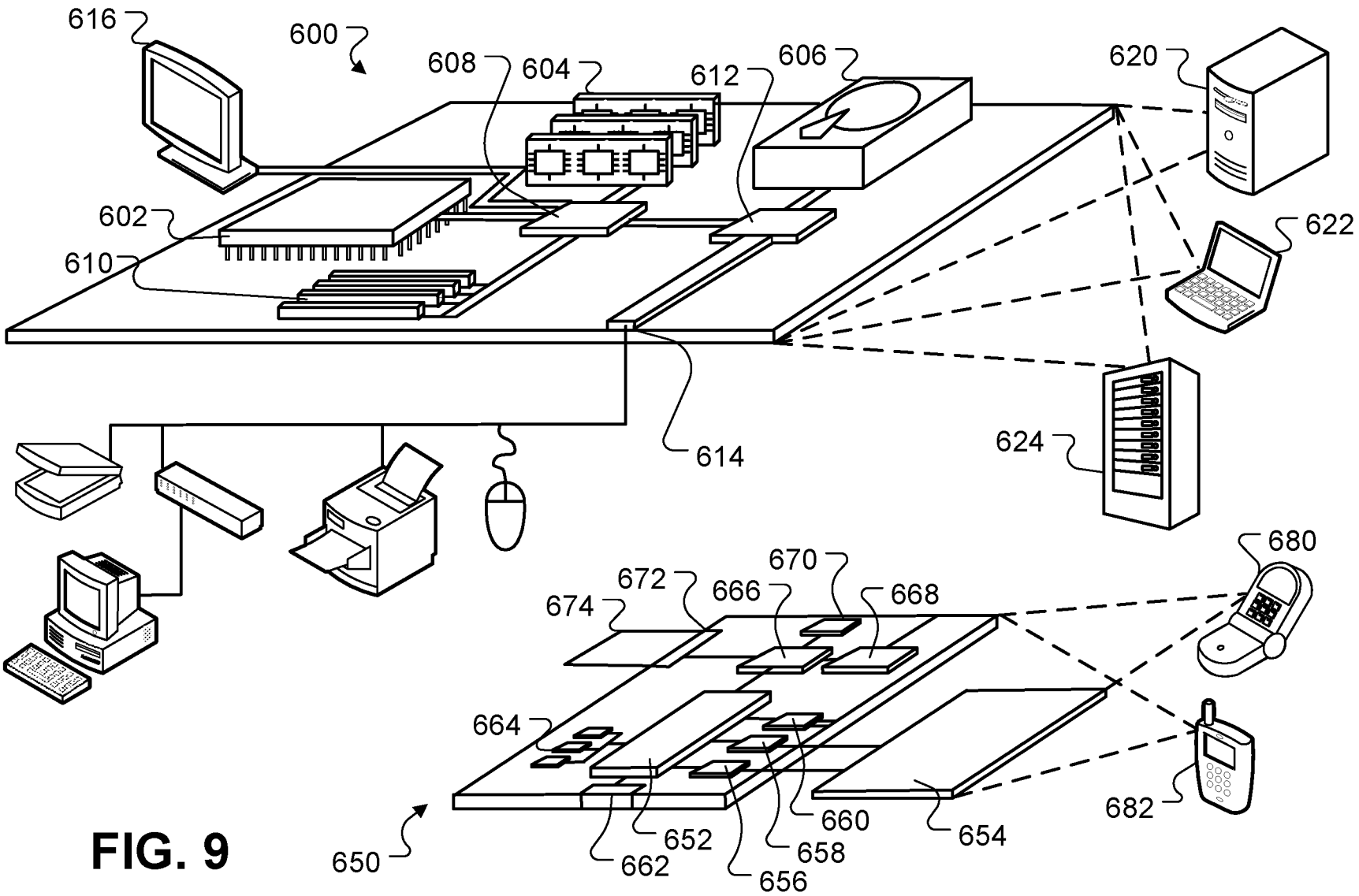
FIG. 9 illustrates an example of a computing device and a mobile computing device that can be used to implement the techniques described in this disclosure.

FIG. 9 shows an example computer device 600 and an example mobile computer device 650, which can be used to implement the techniques described in this disclosure. For example, a portion or all of the operations of the controller may be executed by the computer device 600, the mobile computer device 650, or both. Computing device 600 is intended to represent various forms of digital computers, including, for example, laptops, desktops, workstations, personal digital assistants, servers, blade servers, mainframes, and other appropriate computers. Computing device 650 is intended to represent various forms of mobile devices, including, for example, personal digital assistants, cellular telephones, smartphones, and other similar computing devices. The components shown here, their connections and relationships, and their functions, are meant to be examples only, and are not meant to limit implementations of the techniques described, claimed in this document, or both.

Computing device 600 includes processor 602, memory 604, storage device 606, high-speed interface 608 connecting to memory 604 and high-speed expansion ports 610, and low speed interface 612 connecting to low speed bus 614 and storage device 606. Each of components 602, 604, 606, 608, 610, and 612, are interconnected using various busses, and can be mounted on a common motherboard or in other manners as appropriate. Processor 602 can process instructions for execution within computing device 600, including instructions stored in memory 604 or on storage device 606, to display graphical data for a graphical user interface on an external input/output device, including, for example, display 616 coupled to high speed interface 608. In other implementations, multiple processors, multiple buses, or both can be used, as appropriate, along with multiple memories and types of memory. Also, multiple computing devices 600 can be connected, with each device providing portions of the necessary operations (for example, as a server bank, a group of blade servers, or a multi-processor system).

Memory 604 stores data within computing device 600. In one implementation, memory 604 is a volatile memory unit or units. In another implementation, memory 604 is a non-volatile memory unit or units. Memory 604 also can be another form of computer-readable medium, including, for example, a magnetic or optical disk.

Storage device 606 is capable of providing mass storage for computing device 600. In one implementation, storage device 606 can be or contain a computer-readable medium, including, for example, a floppy disk device, a hard disk device, an optical disk device, a tape device, a flash memory or other similar solid state memory device, or an array of devices, including devices in a storage area network or other configurations. A computer program product can be tangibly embodied in a data carrier. The computer program product also can contain instructions that, when executed, perform one or more methods, including, for example, those described above. The data carrier is a computer- or machine-readable medium, including, for example, memory 604, storage device 606, or memory on processor 602.

High-speed controller 608 manages bandwidth-intensive operations for computing device 600, while low speed controller 612 manages lower bandwidth-intensive operations. Such allocation of functions is an example only. In one implementation, high-speed controller 608 is coupled to memory 604, display 616 (for example, through a graphics processor or accelerator), and to high-speed expansion ports 610, which can accept various expansion cards (not shown). In the implementation, the low-speed controller 612 is coupled to storage device 606 and low-speed expansion port 614. The low-speed expansion port, which can include various communication ports (for example, USB, BLUETOOTH®, Ethernet, wireless Ethernet), can be coupled to one or more input/output devices, including, for example, a keyboard, a pointing device, a scanner, or a networking device including, for example, a switch or router (for example, through a network adapter).

Computing device 600 can be implemented in a number of different forms, as shown in the figure. For example, it can be implemented as standard server 620, or multiple times in a group of such servers. It also can be implemented as part of rack server system 624. In addition or as an alternative, it can be implemented in a personal computer (for example, laptop computer 622). In some examples, components from computing device 600 can be combined with other components in a mobile device (not shown) (for example, device 650). Each of such devices can contain one or more of computing device 600, 650, and an entire system can be made up of multiple computing devices 600, 650 communicating with each other.

Computing device 650 includes processor 652, memory 664, and an input/output device including, for example, display 654, communication interface 666, and transceiver 668, among other components. Device 650 also can be provided with a storage device, including, for example, a microdrive or other device, to provide additional storage. Components 652, 664, 654, 666, and 668, may each be interconnected using various buses, and several of the components can be mounted on a common motherboard or in other manners as appropriate.

Processor 652 can execute instructions within computing device 650, including instructions stored in memory 664. The processor can be implemented as a chipset of chips that include separate and multiple analog and digital processors. The processor can provide, for example, for the coordination of the other components of device 650, including, for example, control of user interfaces, applications run by device 650, and wireless communication by device 650.

Processor 652 can communicate with a user through control interface 658 and display interface 656 coupled to display 654. Display 654 can be, for example, a TFT LCD (Thin-Film-Transistor Liquid Crystal Display) or an OLED (Organic Light Emitting Diode) display, or other appropriate display technology. Display interface 656 can comprise appropriate circuitry for driving display 654 to present graphical and other data to a user. Control interface 658 can receive commands from a user and convert the commands for submission to processor 652. In addition, external interface 662 can communicate with processor 642, so as to enable near area communication of device 650 with other devices. External interface 662 can provide, for example, for wired communication in some implementations, or for wireless communication in other implementations. Multiple interfaces also can be used.

Memory 664 stores data within computing device 650. Memory 664 can be implemented as one or more of a computer-readable medium or media, a volatile memory unit or units, or a non-volatile memory unit or units. Expansion memory 674 also can be provided and connected to device 650 through expansion interface 672, which can include, for example, a SIMM (Single In Line Memory Module) card interface. Such expansion memory 674 can provide extra storage space for device 650, may store applications or other data for device 650, or both. Specifically, expansion memory 674 can also include instructions to carry out or supplement the processes described above and can include secure data. Thus, for example, expansion memory 674 can be provided as a security module for device 650 and can be programmed with instructions that permit secure use of device 650. In addition, secure applications can be provided through the SIMM cards, along with additional data, including, for example, placing identifying data on the SIMM card in a non-hackable manner.

The memory can include, for example, flash memory, NVRAM, both memory, as discussed below. In one implementation, a computer program product is tangibly embodied in a data carrier. The computer program product contains instructions that, when executed, perform one or more methods, including, for example, those described above. The data carrier is a computer- or machine-readable medium, including, for example, memory 664, expansion memory 674, memory, or combinations of these mediums on processor 652, which can be received, for example, over transceiver 668 or external interface 662.

Device 650 can communicate wirelessly through communication interface 666, which can include digital signal processing circuitry where necessary. Communication interface 666 can provide for communications under various modes or protocols. Such communication can occur, for example, through radio-frequency transceiver 668. In addition, short-range communication can occur, including, for example, using a BLUETOOTH®, Wi-Fi, or other such transceiver (not shown). In addition, GPS (Global Positioning System) receiver module 670 can provide additional navigation- and location-related wireless data to device 650, which can be used as appropriate by applications running on device 650.

Device 650 also can communicate audibly using audio codec 660, which can receive spoken data from a user and convert it to usable digital data. Audio codec 660 can likewise generate audible sound for a user, including, for example, through a speaker, for example, in a handset of device 650. Such sound can include sound from voice telephone calls, recorded sound (for example, voice messages, music files, and the like) and also sound generated by applications operating on device 650.

Computing device 650 can be implemented in a number of different forms, as shown in the figure. For example, it can be implemented as cellular telephone 680. It also can be implemented as part of smartphone 682, personal digital assistant, or other similar mobile device.

Various implementations of the systems and techniques described here can be realized in digital electronic circuitry, integrated circuitry, specially designed ASICs (application specific integrated circuits), computer hardware, firmware, software, or combinations of these. These various implementations can include one or more computer programs that are executable, interpretable, or both on a programmable system. This includes at least one programmable processor, which can be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural object-oriented programming language, in assembly/machine language, or both. As used in this disclosure, the terms machine-readable medium and computer-readable medium refer to a computer program product, apparatus, device, or device (for example, magnetic discs, optical disks, memory, Programmable Logic Devices (PLDs)) used to provide machine instructions, data, or both to a programmable processor, including a machine-readable medium that receives machine instructions.

To provide for interaction with a user, the systems and techniques described here can be implemented on a computer having a display device (for example, a CRT (cathode ray tube) or LCD (liquid crystal display) monitor) for presenting data to the user, and a keyboard and a pointing device (for example, a mouse or a trackball) by which the user can provide input to the computer. Other kinds of devices can be used to provide for interaction with a user as well. For example, feedback provided to the user can be a form of sensory feedback (for example, visual feedback, auditory feedback, or tactile feedback). Input from the user can be received in a form, including acoustic, speech, or tactile input.

The systems and techniques described here can be implemented in a computing system that includes a backend component (for example, as a data server), or that includes a middleware component (for example, an application server), or that includes a frontend component (for example, a client computer having a user interface or a Web browser through which a user can interact with an implementation of the systems and techniques described here), or a combination of such backend, middleware, or frontend components. The components of the system can be interconnected by a form or medium of digital data communication (for example, a communication network). Examples of communication networks include a local area network (LAN), a wide area network (WAN), and the Internet.

The computing system can include clients and servers. A client and server are generally remote from each other and typically interact through a communication network. The relationship of client and server arises by virtue of computer programs running on the respective computers and having a client-server relationship to each other.

The tools and methods described in this disclosure can be used downhole in drilling wells to accurately deliver solutions and objects to points of interest downhole. The drilling tool includes multiple moveable arms that function to accurately adjust, guide, and place objects into an area of interest down hole. These objects can be but not limited to: specially designed lost circulation material, welding filler material, and surveying tools. These objects can be pumped from the surface through the drill string down to the multiple articulated and individually controlled arms of the drilling tool. The areas of interest in which the pumped objects are placed using the multiple articulated and individually controlled arms can be but not limited to: fractures in downhole formation rocks, and cracks in downhole tubulars such as well casings. The arms are controlled by an algorithm to place the pumped objects into the areas of interest accurately. The arms also have the ability to perform adjustments to the objects pumped through the arms. These adjustments are but not limited to: coiling of the welding filler material, and adjusting the diameter of the welding filler material.

A number of embodiments of the tools and methods have been described. Nevertheless, it will be understood that various modifications may be made without departing from the spirit and scope of the disclosure. For example, while the illustrated implementation shows a vertical wellbore, the principles of this disclosure can also be applied to a deviated or horizontal wellbore as well. The arms shown in the figures are generally depicted as being identical to each other. However, in some implementations, the arms can be different from each other. One arm can be configured, for example, to delivery coil of a different thickness than another arm is configured to deliver. To reach specific positions in a wellbore, the DWD sub can be rotated (for example, by the operator or by the algorithm) to position the desired arm (for example, an arm with particular desired characteristics for the application for the point of interest) at the point of interest.

Accordingly, other embodiments are within the scope of the following claims.

What is claimed is:

1. A downhole drilling tool comprising:

a body with a wall that defines an internal volume, the body comprising:

a first connection point, a second connection point, and a longitudinal axis defined between the first and second connection points; and at least one arm attached to the wall extending parallel to the longitudinal axis from a corresponding joint arranged on an external surface of the body between the first connection point and second connection point, each arm of the at least one arm extending from a first end attached to the corresponding joint to a free second end with an arm joint disposed between the first end and the free second end, each arm defining a channel within a body of each arm;

wherein the at least one arm provides fluid paths connecting the internal volume to outside the body, wherein the at least one arm is displaceable relative to the wall;

wherein the corresponding joint is a rotatable joint attached to the wall, and wherein the arm joint is a pivotable joint and is configured to extend the free second end radially outward along a lateral axis.

2. The downhole drilling tool of claim 1, wherein the wall defines at least one recess sized to receive the at least one arm.

3. The downhole drilling tool of claim 1, wherein the rotatable joint provides one degree of freedom for the at least one arm relative to the wall.

4. The downhole drilling tool of claim 3, wherein the rotatable joint provides more than one degree of freedom for the at least one arm relative to the wall.

5. The downhole drilling tool of claim 1, comprising a magnet attached at a distal end of the at least one arm.

6. The downhole drilling tool of claim 1, wherein the at least one arm comprises a first arm and a second arm, the first arm having a length that is different from a length of the second arm.

7. The downhole drilling tool of claim 1, wherein the at least one arm comprises a first and a second arm and the second arm has a length different from a length of the first arm.

8. A wellbore system comprising:

a wall defining a wellbore formed into a geologic formation;

a circulation pump configured to circulate fluid through the wellbore;

a downhole drilling tool comprising:

a drill string sub defining an internal volume, the drill string sub having a first connection point and a second connection point defining a longitudinal axis; and multiple arms, each arm extending parallel to the longitudinal axis from a joint arranged on an external surface of the drill string sub, attached to the circumference of the drill string sub, each arm of the multiple arms extending from a first end attached to the joint to a tree second end with an arm joint disposed between the first end and the free second end, each arm defining a channel within a body of each arm;

wherein the multiple arms provide a fluid path from the internal volume of the drill string sub to an outside of the drill string sub, and wherein the multiple arms are displaceable relative to the drill string sub to adjust, guide, and place objects into an area of interest outside of the drill string sub;

wherein the joint is a rotatable joint, and wherein the arm joint is a pivotable joint and is configured to extend the free second end radially outward along a lateral axis; and a controller in communication with the driving tool that sends signals to control the displacement of the multiple arms.

9. The system of claim 8, wherein the wellbore system further comprises a drill string that is a wired string that provides power to the drilling tool.

10. The system of claim 9, wherein the power is provided by an integrated fiber optics power transmission line.

11. The system of claim 8, comprising a downhole power supply unit that provides power to the drilling tool.

12. The system of claim 11, wherein the power supply unit is a rechargeable battery or an energy harvester.

13. The system of claim 8, wherein the controller controls each arm independently from the arms.

14. The system of claim 8, further comprising a delivery item compartment arranged within the downhole drilling tool.

15. The system of claim 14, wherein the delivery item compartment is accessible by the arms.

* * * * *